US005173675A

United States Patent [19]

Leduc

[11] Patent Number: 5,173,675

[45] Date of Patent: Dec. 22, 1992

[54] MOUNTING FOR AN ELECTROMAGNETIC RELAY ARMATURE

[75] Inventor: Leon Leduc, East Detroit, Mich.

[73] Assignee: United Technologies Automotive, Inc., Dearborn, Mich.

[21] Appl. No.: 816,500

[22] Filed: Dec. 31, 1991

[51] Int. Cl.[5] ..... H01H 51/22

[52] U.S. Cl. ..... 335/80; 335/78; 335/128

[58] Field of Search ..... 335/78-86, 335/124, 128, 131, 133

[56] References Cited

U.S. PATENT DOCUMENTS 4,684,910 8/1987 Dittmann et al. ..... 335/274
4,691,181 9/1987 Katsutan et al. ..... 335/128
5,063,366 11/1991 Edelhaeuser et al. ..... 335/128

*Primary Examiner*—Lincoln Donovan

[57] ABSTRACT

A structure for mounting an armature assembly to a frame of an electromagnetic relay is disclosed. Various construction details are developed which disclose a shaped bearing disposed on a frame and an armature assembly having a complementary bearing surface. The engagement of the shaped bearing and bearing surface permits pivoting of the armature assembly while providing capture of the armature assembly to the frame. In one embodiment, an electromagnetic relay (70) includes a frame (72) having a pair of spherical bearings (88, 90) and an armature assembly (78) having a pair of spherical recesses (102, 104) formed and positioned to complement the spherical bearings.

7 Claims, 1 Drawing Sheet

MOUNTING FOR AN ELECTROMAGNETIC RELAY ARMATURE

TECHNICAL FIELD

This invention relates to electromagnetic relays, and more particularly to a mounting arrangement for an armature assembly.

BACKGROUND ART

Electromagnetic relays are well known and have found a variety of useful applications as switching devices. As shown in FIGS. 1, 2 and 3, a typical relay 12 includes a frame 14 and a coil assembly 16 mounted on the frame and having a core 18. An armature assembly 22 is resiliently mounted to the frame. At least one primary pair of electrical contacts 34, 48 is disposed between the armature assembly and frame. The armature assembly pivots on the frame and, in its initial position, is spaced from the core by a gap such that the electrical contacts do not mate.

A relay performs its switching function when the coil assembly is energized. The energized coil assembly creates a magnetic field which urges the armature assembly toward the core to decrease the gap. Upon sufficient closing of the gap the primary pair of electrical contacts will mate and thereby close a related electrical circuit. When the coil assembly is de-energized the armature assembly springs back to its initial position, the contacts separate and the circuit is opened. In addition, some electromagnetic relays include a supplemental pair of contacts 36, 50. The supplemental contacts are typically disposed between the armature assembly and frame but opposite of the primary pair of electrical contacts. The supplemental pair of contacts permit the relay to close a supplemental circuit with the armature assembly in its initial, de-energized position.

A strong magnetic field is generally a desirable feature. Upon closing the gap between the armature assembly and the core, the force generated by the magnetic field will cause the armature to bend in a manner similar to a loaded beam supported at its ends. The bending of the armature produces a wiping motion between the mating contacts rather than abutting contact. The wiping motion helps to prevent welding of the mating contacts which may occur in high current (in excess of 10 Amp) applications and extends the life of the contacts.

Increased magnetic force also reduces the occurrence of "bounce". Bounce occurs if the mating force between two electrical contacts is insufficient. Insufficient mating force causes the two contacts to rebound from each other on initial contact. Bounce results in lower reliability of the switching function of the electromagnetic relay and increased wear between the contacts.

The resilient mounting of the armature assembly is typically accomplished by the use of a helical spring 24, as shown in FIG. 1. The spring has one end mounted to the frame and the opposite end mounted to an extension 44 of the armature assembly. Tension from the spring pivots the armature assembly. The spring provides a resisting force to prevent closure of the gap between the armature assembly and core until sufficient electrical current is supplied to the coil. Additionally, the spring provides a restoring force to return the armature assembly to its initial position and open the primary circuit when the coil is de-energized. The spring force required, and therefore the size of the spring, is directly proportional to the strength of the magnetic field generated by the coil assembly.

The frame includes a side wall 28 having a shoulder 30. The armature assembly pivots on the shoulder. Frame locking extrusions 52 are disposed on the side wall. The armature assembly includes cut-outs 54 configured to engage the frame locking extrusions. The frame locking extrusions engage the cut-outs to prevent lateral movement of the armature assembly. Excessive movement may create a misalignment of the electrical contacts. As the electromagnetic relay is used, however, the armature assembly will slide in the direction indicated by arrow 56. As a result, contact may occur between the surfaces 58 of the frame locking extrusions and the surfaces 60 of the cut-outs. Eventually, this contact may cause the armature assembly to bind up on the frame. Binding reduces the useful life of the electromagnetic relay.

An alternate type of electromagnetic relay which addresses the problem of binding contact between the armature assembly and the frame is the blade-type electromagnetic relay. This type of electromagnetic relay utilizes a copper blade element which functions both as an armature assembly and as a spring. The blade element is mounted directly to the frame, typically by welding one end of the blade element to a side wall of the frame. The blade element curves around a shoulder of the frame, with the curvature of the element biasing the element away from the core. In this arrangement, the pivot point for the armature assembly is within the blade element and there is no pivoting contact between the armature assembly and the frame.

While the blade type relay solves the problem of wear and relative movement between the armature and frame, there are several limitations to its use. First, the blade type spring is limited to lower spring forces as compared to conventional helical springs used in comparable sized relays. The lower restoring force increases the wear of the electrical contacts and increases the possibility of bounce occurring. Second, the blade type springs are also limited to lower temperature applications due to annealing of the copper blade elements at temperatures encountered by the electromagnetic relays during automotive use. This results in limiting the blade type electromagnetic relay to lower temperature and lower current applications than the helical spring type electromagnetic relay. The third and most significant limitation is the difficulty and expense of manufacturing the blade type electromagnetic relays. The difficulty and expense are caused by the requirement for precise positioning of the blade element during attachment to the frame. This precision is necessary to ensure proper alignment of the contacts.

The above art notwithstanding, scientists and engineers under the direction of Applicant's Assignee are working to develop electromagnetic relays with increased useful lives for utilization in high current, high temperature applications.

DISCLOSURE OF INVENTION

This invention is predicated in part upon the recognition by the Applicant that in a conventional, high current electromagnetic relay the spring force $F_s$ has a component which urges the armature assembly to slide laterally on the shoulder. As shown in FIG. 4, the spring force $F_s$ can be broken down into perpendicular force components, $F_y$ and $F_x$. The first force component $F_y$ is perpendicular to the armature assembly and urges the armature assembly to pivot about the shoulder of the frame. The second force component $F_x$ is parallel to the plane of the armature assembly. It is the in-plane component $F_x$ which urges the armature assembly to slide laterally on the shoulder.

An object of the present invention is a resiliently mounted armature assembly which is captured to the frame of an electromagnetic relay.

Another object of the present invention is to increase the useful life of electromagnetic relays.

According to the present invention, an electromagnetic relay includes a cooperating pair of bearing surfaces which permit an armature assembly pivotal motion while capturing the armature assembly to a frame.

According to a specific embodiment of the present invention, an electromagnetic relay having a frame and an armature assembly includes shaped bearings trapped therebetween which permit the armature assembly to pivot with respect to the frame while blocking relative lateral movement.

A primary feature of the present invention is the cooperating bearing surfaces between the frame and the armature assembly. Another feature is the elimination of extrusions on the frame and cut-outs in the armature assembly. A further feature is an enlarged or slotted recess in the armature assembly.

A principal advantage of the present invention is the avoidance of lateral movement and misalignment of the armature assembly relative to the frame which results from the cooperating bearing surfaces. The bearing surfaces capture the armature assembly to the frame. A further advantage is the length of useful life which results from eliminating the extrusions on the frame. Another advantage is the ease of fabrication of the electromagnetic relay as a result of the slotted recess which avoids precise positioning of the bearing surfaces.

The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
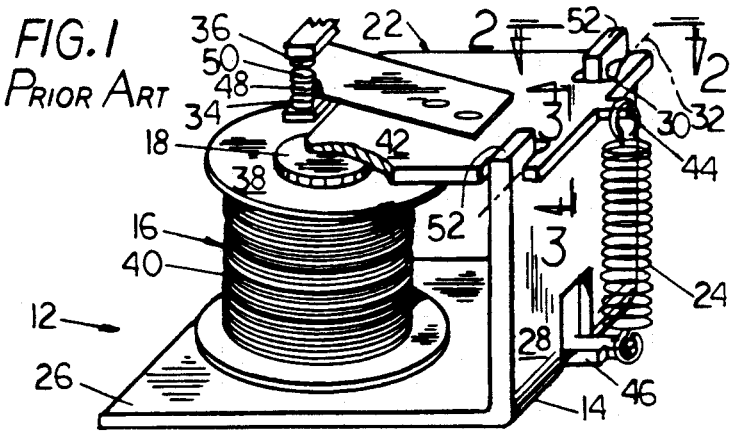
FIG. 1 PRIOR ART
FIG. 1 is a perspective view of an electromagnetic relay in accordance with the prior art.
Figure 2:
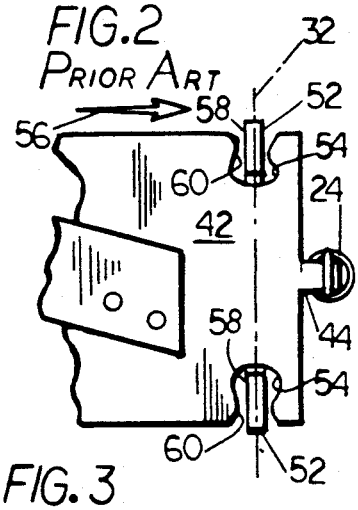
FIG. 2 PRIOR ART
FIG. 2 is a view taken along line 2—2 of FIG. 1 of an electromagnetic relay in accordance with the prior art.
Figure 5:
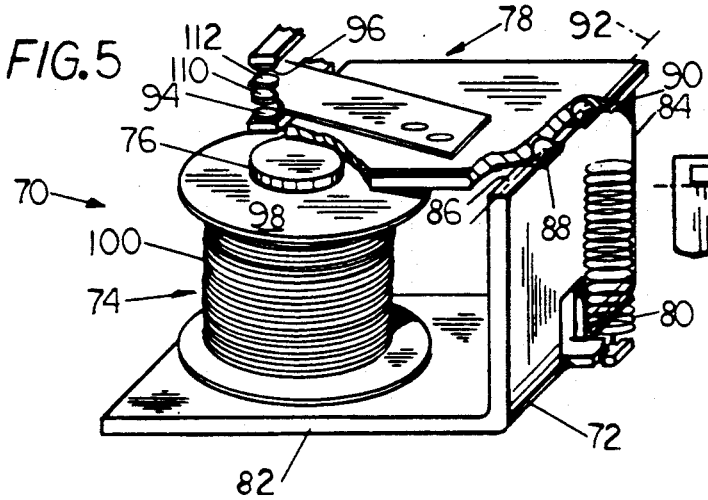
FIG. 5 is a perspective view of an electromagnetic relay in accordance with the present invention.
Figure 3:
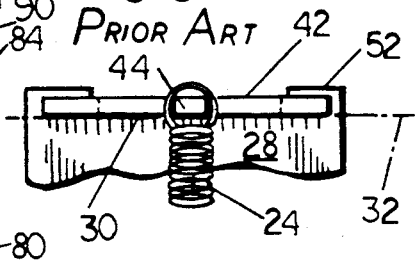
FIG. 3 PRIOR ART
FIG. 3 is a view taken along line 3—3 of FIG. 1 of an electromagnetic relay in accordance with the prior art.

Referring now to FIG. 5, an electromagnetic relay 70 in accordance with the present invention is 25 illustrated. The electromagnetic relay 70 is comprised of a frame 72, a coil assembly 74 having a core 76, an armature assembly 78, and a helical spring 80. The frame 72 has a base portion 82 and a side wall portion 84 with a shoulder 86 having two spherical bearings 88, 90 are fixedly attached so as to be integral with (i.e. act as one piece) the shoulder 86. The spherical bearings 88, 90 define a pivoting axis 92. The frame 72 also includes a first primary contact 94 and a first supplemental contact 96.

The coil assembly 74 includes a bobbin 98 mounted on the frame 72 and a coil 100 circumferentially wound around the bobbin 98. The core 76 is concentrically mounted within the bobbin 98 and coil 100. As with prior art electromagnetic relays, the coil 100 is energized by a source of electrical current and a magnetic field is generated about the core 76.

The armature assembly 78 has two recesses 102, 104 and a platform 106 with an extension 108 which engages the spring 80. The recesses 102, 104 engage the spherical bearings 88, 90 to provide a pivot point. The armature assembly 78 also includes a second primary contact 110 and a second supplemental contact 112. The second supplemental contact 112 is positioned to engage the first supplemental contact 96 to close the supplemental circuit. The second primary contact 110 is positioned to engage the first primary contact 94 to close the primary circuit.

Figure 6:
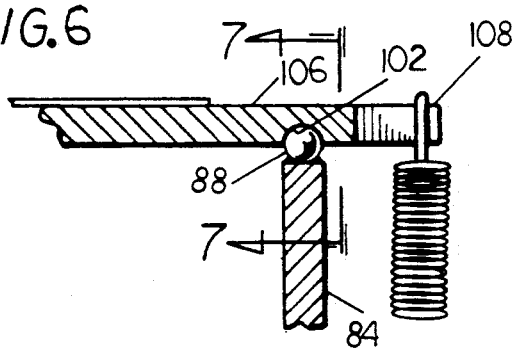
FIG. 6 is a cross-sectional view of the pivoting relationship between the armature assembly and the frame.
Figure 7:
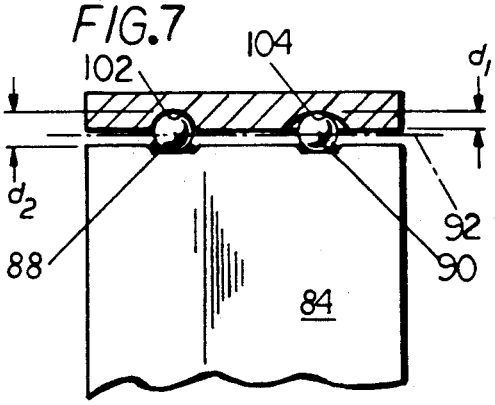
FIG. 7 is a partially sectioned view taken along line 7—7 of FIG. 6.

Referring now to FIGS. 6 and 7, the pair of spherical bearings 88, 90 are bearing surfaces for the shoulder 86 of the frame 72. The mounting of the spherical bearings 88, 90 to the frame 72 can be accomplished by any conventional means available. One satisfactory means is to weld the spherical bearings 88, 90 to the frame 72.

The pair of recesses 102, 104 are bearing surfaces for the platform 106. The first recess 102 is sized and located to compliment the first spherical bearing 88. The second recess 104 is slotted or enlarged relative to the second spherical bearing 90. The enlargement permits the use of more than one spherical bearing without necessitating highly precise positioning. The amount of movement permitted by the second recess 104 is insufficient to cause a misalignment of the contacts. The use of two complementary pairs of bearing surfaces maintains the proper alignment of the pairs of electrical contacts by preventing the platform 106 from any significant lateral movement within the plane of the platform 106. As mentioned previously, significant lateral movement is defined as movement within the plane of the platform 106 which would cause a misalignment of the contacts.

Figure 4:
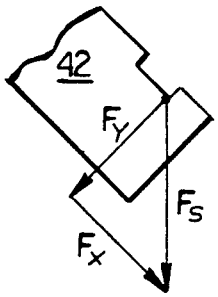
FIG. 4 is a force diagram illustrating the force components of a spring force relative to an armature assembly platform.

The depth d1 of the recesses 102, 104 should be sufficient to capture the armature assembly 78 to the frame. Capture of the armature assembly 78 will limit the platform 106 to pivoting about the shoulder 86 and restrain the armature assembly 78 from other motion which may cause a misalignment of the contacts. Significantly, capture provided by the cooperating bearing surfaces will block movement in the direction urged by $F_x$ (see FIG. 4). A recess having a depth of approximately one-third ($\frac{1}{3}$) to one-half ($\frac{1}{2}$) the diameter d2 of the spherical bearings is believed satisfactory.

During operation, with the coil 100 de-energized, tension from the spring 80 pivots the platform 106 on the spherical bearings 88, 90 such that the separation between the first and second supplemental contacts 96, 112 is closed. This is the initial position of the armature assembly 78. In the energized condition, a supply of electrical current to the coil 100 creates a magnetic field centered about the core 76. The magnetic field produces a force which oppositely (relative to the pivoting force of the spring 80) pivots the platform 106 on the spherical bearings 86, 90 such that the separation between the first and second primary contacts 94, 110 is closed. This is the energized position of the armature assembly 76. The spring 80 provides a restoring force such that, upon the termination of the supply of current to the coil 100, the armature assembly 76 returns to its initial position.

It should be noted that the invention takes advantage of the presence of the perpendicular component $F_y$ (see FIG. 4) of the spring force $F_s$. Besides pivoting the armature assembly 76 about the shoulder 86, the component $F_y$ is also used as a mating force to ensure engagement between the complementary pairs of bearing surfaces. Disengagement of the bearing surfaces may occur as a result of inadvertent impact of the electromagnetic relay 70. In the initial position, component $F_y$, in conjunction with a reaction force at the first supplemental contact 96, prevents the recesses 102, 104 from becoming disengaged from the spherical bearings 88, 90. Similarly, in the energized position, component $F_y$, in conjunction with the magnetic force, prevents disengagement of the recesses 102, 104 from the spherical bearings 88, 90.

Although the invention as disclosed in FIGS. 5–7 illustrates an embodiment which uses spherical bearings as a bearing surface, it should be understood by those skilled in the art that shaped bearing surfaces of a non-spherical variety which permit pivoting of the armature assembly while providing capture may also be used. The relative positions of the spherical bearings and recesses may also be reversed, i.e. the spherical bearings may be mounted on the armature assembly and the spherical recesses may be disposed on the shoulder or the bearing surfaces may be formed integral with either the frame or the armature assembly. In addition, although the embodiment illustrated in FIGS. 5–7 shows two spherical bearings, a varying number of bearings or shaped bearing surfaces may be used.

Although the invention has been shown and described with respect to exemplary embodiments thereof, it should be understood by those skilled in the art that various changes, omissions and additions may be made thereto, without departing from the spirit and scope of the invention.

I claim:

1. An improved electromagnetic relay of the type having a pivoting axis, a frame having a base portion and a side wall portion with a shoulder, a coil assembly disposed on the base portion and having a core concentrically positioned within the coil assembly, a first primary electrical contact disposed in a fixed relationship with the frame, an armature assembly pivotally disposed on the shoulder, the armature assembly having a platform and a second primary electrical contact, the platform defining a plane, the second primary electrical contact positioned to make contact with the first electrical contact upon sufficient pivoting of the armature assembly towards the core, and a spring disposed between the frame and the armature assembly, the spring having a spring force $F_s$ with a force component $F_y$ directed perpendicular to the plane which urges the armature assembly to pivot about the pivoting axis and with a force component $F_x$ directed parallel to the plane which urges the armature assembly to move laterally, wherein the improvement comprises:

a first bearing surface disposed on the shoulder and a second bearing surface disposed on the armature assembly, said second bearing surface adapted to engage said first bearing surface to permit the armature assembly pivotal movement about the pivoting axis and to block lateral movement of the armature assembly.

2. The improved electromagnetic relay according to claim 1, wherein said first bearing surface is a shaped bearing fixedly attached to the shoulder and wherein said second bearing surface is a recess sized and positioned to cooperate with said bearing.

3. The improved electromagnetic relay according to claim 2, wherein said shaped bearing is a spherical bearing.

4. The improved electromagnetic relay according to claim 2, further comprising a second pair of bearing surfaces, wherein one of said second pair of bearing surfaces is a second shaped bearing fixedly attached to the shoulder, and the other of said second pair of bearing surfaces is a second recess disposed on the armature assembly, said second recess adapted to engage said second shaped bearing to permit the armature assembly pivotal movement about the pivoting axis and to block lateral movement of the armature assembly.

5. The improved electromagnetic relay according to claim 4, wherein said second shaped bearing is a spherical bearing.

6. The improved electromagnetic relay according to claim 4, wherein said second recess is enlarged relative to said second shaped bearing, said second recess sized to prevent significant lateral movement of the armature assembly within the plane of the platform.

7. The improved electromagnetic relay according to claim 1, wherein the spring is a helical spring having one end disposed on the frame and the opposite end disposed on the armature assembly.

* * * * *